United States Patent [19]

McCollom

[11] Patent Number: 4,970,917

[45] Date of Patent: Nov. 20, 1990

[54] STUD EXTRACTOR AND WRENCH APPARATUS

[76] Inventor: Robert M. McCollom, 3103 N. Elizabeth, Pueblo, Colo. 81008

[21] Appl. No.: 357,990

[22] Filed: May 30, 1989

[51] Int. Cl.[5] ..... B25B 13/50

[52] U.S. Cl. ..... 81/53.2; 81/3.44

[58] Field of Search ..... 81/53.2, 3.44, 129; 279/6, 71

[56] References Cited

U.S. PATENT DOCUMENTS 1,279,349 9/1918 Johnson ..... 81/53.2

2,681,582 6/1954 Valvano ..... 81/53.2

*Primary Examiner*—Roscoe V. Parker

*Attorney, Agent, or Firm*—Phillip A. Rein

[57] ABSTRACT

This invention relates to a stud extractor and wrench apparatus using a cam action locking feature to grasp a stud member or bolt head member for removing same. The stud extractor and wrench apparatus includes a main cam lock assembly driven through a main drive assembly. The main drive assembly can utilize a conventional ratchet drive assembly or can take the form of a box end wrench drive assembly. The main cam lock assembly includes an outer housing member having mounted therewithin a cam insert member. The outer housing member has an elliptical cavity opening with an inner cam surface and a wrench head section. The wrench head section resembles a standard socket wrench member which is engagable with the ratchet drive assembly for rotating in selected opposite directions. The cam insert member can be releasably mounted within the outer housing member and includes an elliptical cam body. The elliptical cam body has a central serrated opening to receive and engage the stud member or bolt head member during a removal operation. The elliptical cam body has an outer cam surface engagable with the inner cam surface of the outer housing member so as to provide for a cam actuated clamping action on relative rotational movement of the outer housing member and the cam insert member. The cam insert member can be color coded and easily placed within or removed from the outer housing member for selecting ones of various sizes for grasping a stripped stud member or bolt head member.

10 Claims, 1 Drawing Sheet

STUD EXTRACTOR AND WRENCH APPARATUS

PRIOR ART

A patent search on this invention revealed the following United States Patents:

| U.S. Pat. No. | Invention | Inventor |
|---|---|---|
| 232,923 | WRENCH | Alfred Beard |
| 1,279,349 | WRENCH | Todd J. Johnson |
| 2,254,681 | SOCKET WRENCH | Fred B. Honchock |
| 2,555,836 | SOCKET WRENCH | Herbert A. Werich |
| 2,560,012 | UNIVERSAL STUD PULLER AND DRIVER | Ralph A. Valvano |
| 2,746,328 | STUD PULLER AND DRIVER WRENCH | Ralph A. Valvano |
| 3,735,650 | EXTRACTOR TOOL | Francis H. Weng, Jr. |
| 3,889,557 | STUD REMOVING TOOL | Richard H. Young |
| 4,724,730 | WRENCH SOCKET WITH CAM LOCKING FEATURE | Mader et al |

The Beard patent discloses a pipe wrench structure having a serrated key structure in order to grasp and rotate a pipe member but is substantially different in appearance and operation.

The Johnson patent discloses a wrench structure which utilizes a pair of wedges in order to move a movable jaw relative to a fixed jaw. This patent addresses a similar problem including serrated jaws which are moved by the wedge structures.

The Honchock patent discloses a socket wrench using a cam action in order to grasp a nut member for removal thereof.

The Werich patent discloses a socket wrench which utilizes contacting cam surfaces on downward pressure in order to grasp a nut member for subsequent rotation thereof.

The Valvano patent (U.S. Pat. No. 2,560,012) discloses a stud puller structure which utilizes a cam action in order to grasp the threads or a smooth shank portion of a stud member.

The Valvano patent (U.S. Pat. No. 2,746,328) discloses a stud puller having an oval shaped opening with a jaw member mounted therein. The jaw member is moved inwardly by adjustment screws and a threaded pin in order to clamp about a stud bolt.

The Weng Jr. patent discloses an extractor tool utilizing a cam action in order to grasp the head of a bolt or screw member.

The Young patent discloses a stud removing tool utilizing a plurality of roller members which are cam actuated in order to grasp a hexagonal head of a bolt member.

The Mader et al patent discloses a plurality of cam members which are moved into a locking, grasping relationship on rotation in either direction.

PREFERRED EMBODIMENT OF THE INVENTION

In one preferred embodiment of this invention, a stud extractor and wrench apparatus is engageable with a stud member mounted in an engine block or a bolt head member and operable through a cam action to be rotated in either direction to grasp the member to be removed. The stud extractor and wrench apparatus includes (1) a main cam lock assembly; and (2) a main drive assembly connectable to the main cam lock assembly. The main drive assembly may be of various embodiments such as (1) a conventional ratchet drive assembly operable to rotate a standard type wrench/socket member; or (2) a box and wrench drive assembly resembling a conventional box end wrench, either one of which can drive the main cam lock assembly. The main cam lock assembly includes (1) an outer housing member; and (2) a cam insert member which is releasably mounted within the outer housing member. The outer housing member is provided with an elliptical cavity opening; a peripheral lip section mounted about the ellipitical cavity opening; and a wrench head section releasably connectable with the ratchet drive assembly. The elliptical cavity opening is provided with an inner cam surface engageable with the cam insert member during use thereof. A second embodiment of the outer housing member is provided with a second peripheral lip section about an aligned stud opening so that the cam insert member can be placed about and at various longitudinal positions on an elongated stud member for removal thereof. The cam insert member is provided with a main elliptical cam body having a central serrated opening; a pair of spaced tool connector openings; an outer cam surface; and an opening or slot along one side thereof. The tool connector openings are adapted to receive end portions of a snap ring tool for removing same from the outer housing member when necessary for change of sizes of cam insert members. The elliptical cam body and, more specifically, the outer cam surface engages the inner cam surface of the elliptical cam opening of the outer housing member when being rotated. The inner cam surface contacts and moves relative to the outer cam surface and causes a decrease in the size of the central serrated opening which results in a grasping of the central serrated opening about the stud member or bolt head member during an extracting or wrenching operation. It is seen that the main cam lock assembly can be constructed as a socket wrench member to be driven by the ratchet drive assembly and can be replaced with various sizes similar to a socket wrench. Also, the main cam lock assembly can be built as an integral end portion of a box and wrench drive assembly as noted in FIGS. 6 and 7.

OBJECTS OF THE INVENTION

One object of this invention is to provide a stud extractor and wrench apparatus including a main cam lock assembly which can be mounted about a stud member or bolt head member utilizing a cam action caused by relative rotation between an outer housing member and a cam insert member to cause a clamping on the stud member or bolt head member for rotation and removal thereof.

One further object of this invention is to provide a stud extractor and wrench apparatus including a main cam lock assembly which can be constructed as an integral part of a box end wrench drive assembly or as a conventionally appearing socket wrench member which can be movable in opposite directions through a conventional ratchet drive assembly in order to grasp and remove a stud member or bolt head member.

One other object of this invention is to provide a stud extractor and wrench apparatus including a main cam lock assembly having a cam insert member mounted within an outer housing member whereby the outer housing member is rotatable relative to the cam insert member to contact and cause a closing of a central serrated opening in the cam insert member which then grasps a stud member or bolt head member for rotation thereof.

One further object of this invention is to provide a stud extractor and wrench apparatus having a main cam lock assembly which can be constructed of a brass or plastic material so as to reduce chances of damage to a stud member or bolt head member which is being removed by this stud extractor and wrench apparatus tool.

Still, one further object of this invention is to provide a stud extractor and wrench apparatus which is easy to use, economical to manufacture, rigid in construction, and substantially maintenance free.

Various other objects, advantages, and features of the invention will become apparent to those skilled in the art from the following discussion, taken in conjunction with the accompanying drawings, in which:

FIGURES OF THE INVENTION

Figure 1:
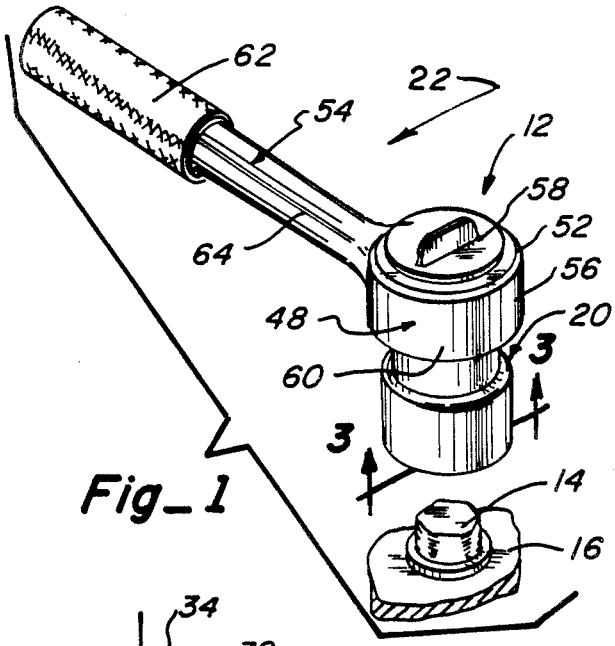
FIG. 1 is a perspect view of a stud extractor and wrench apparatus of this invention as positioned over a stripped bolt head member for attachment and subsequent removal thereof.
Figure 3:
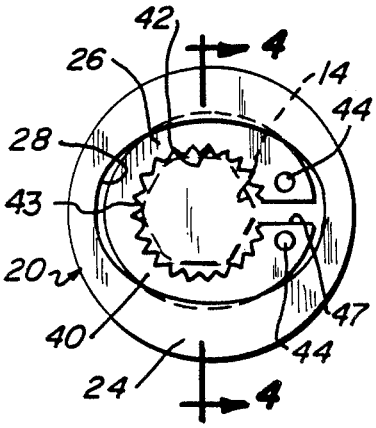
FIG. 3 is an enlarged fragmentary sectional view taken along line 3—3 in FIG. 1.

The following is a discussion and description of preferred specific embodiments of the stud extractor and wrench apparatus of this invention, such being made with reference to the drawings, whereupon the same reference numerals ar used to indicate the same or similar parts and/or structure. It is to be understood that such discussion and description is not to unduly limit the scope of the invention.

DESCRIPTION OF THE INVENTION

Figure 2:
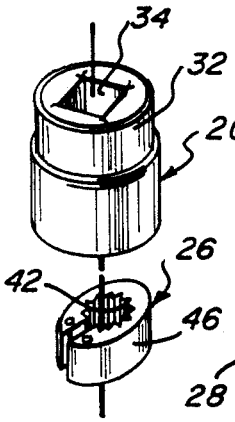
FIG. 2 is an exploded perspective view of a main cam lock assembly of the stud extractor and wrench apparatus of this invention illustrating a removable and replaceable feature of a cam insert member.

Referring to the drawings in detail and, in particular to FIG. 1, a stud extractor and wrench apparatus of this invention, indicated generally at 12, is operable to grasp a stud member 14 mounted within an engine block 16 or a bolt head member 18 which may be of hexagonal or other shapes. The stud member 14 can be a stripped engine block bolt or an elongated bolt having the threads stripped thereon whereupon the entire structure needs to be removed for replacement. An embodiment illustrated in FIG. 6 resembles a box end wrench which allows the stud extractor and wrench apparatus to be placed about and at any longitudinal position the length of an elongated stud member 14 and not having obvious use limitations as with a socket wrench type member as illustrated in FIGS. 1, 2, and 4.

The stud extractor and wrench apparatus 12 includes a main cam lock assembly 20 usable with a main drive assembly 22. The main cam lock assembly 20 comes with a pair of embodiments resembling (1) a standard wrench/socket member as noted in FIG. 2; and (2) formed at the end of the box end wrench illustrated in FIG. 6.

The main cam lock assembly 20 includes an outer housing member 24 operably associated with a replaceable cam insert member 26.

Figure 5:
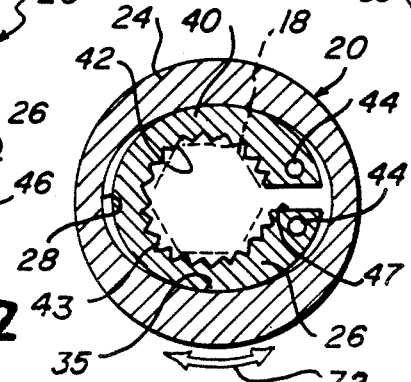
FIG. 5 is an enlarged sectional view taken along line 5—5 in FIG. 4.
Figure 4:
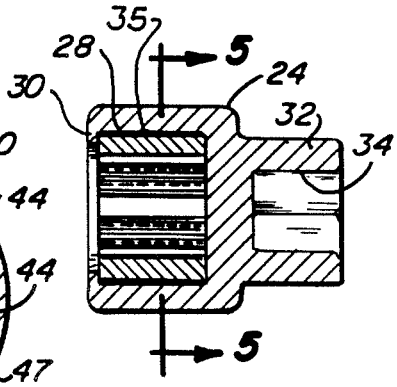
FIG. 4 is a reduced sectional view taken along line 4—4 in FIG. 3.

As noted in FIGS. 4 and 5, the outer housing member 24 is provided with an elliptical cavity opening 28; a peripheral lip section 30 mounted about the elliptical cavity opening 28; and a wrench head section 32. The elliptical cavity opening 28 has an inner cam surface 35 engagable with the cam insert member 26 during operation in a manner to be explained. The lip section 30 acts to retain the cam insert member 26 within the elliptical cavity opening 28 during use thereof.

The wrench head section 32 is provided with a ratchet connector opening 34 of generally square shape which is adapted to be engageable with a portion of the main drive assembly 22.

Figure 6:
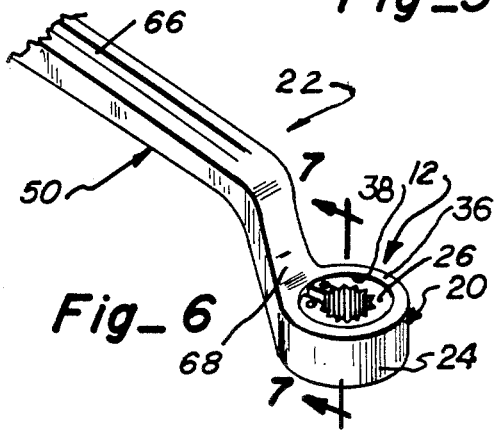
FIG. 6 is a fragmentary perspective view of a box end wrench drive assembly embodiment of the invention having the main cam block assembly connected to one end of a box end wrench.
Figure 7:
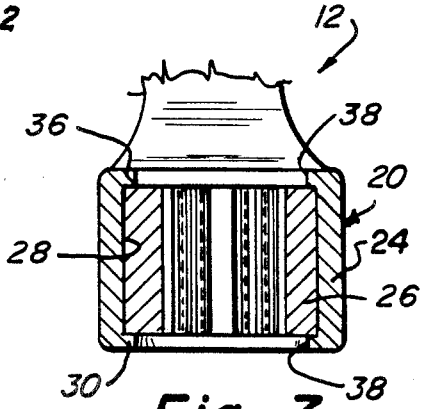
FIG. 7 is an enlarged sectional view taken along line 7—7 in FIG. 6.

A second embodiment of the outer housing member 24 is noted in FIGS. 6 and 7 whereupon the elliptical cavity opening 28 is provided with a second opposed peripheral lip section 36 placed about opposed aligned stud openings 38. This allows for the stud member 14 to extend upwardly through the stud openings 38 in order to grasp any portion thereof for rotating and removing the entire stud member 14.

The cam insert member 26 includes an elliptical cam body 40 of a height slightly less than the depth of the elliptical cavity opening 28 as noted in FIGS. 4 and 7. The elliptical cam body 40 is provided with a central serrated opening 42 having teeth or notched sections 43; a pair of adjacent tool connector openings 44 for attachment to a snap ring tool; an outer cam surface 46 engagably with the inner cam surface 35 when mounted within the outer housing member 24; and an opening or slot 47. It is noted that a snap ring tool can be placed within the tool connector opening 44 so as to move the adjacent surfaces of the opening or slot 47 into abutting positions so that the entire cam insert member 26 can be removed from the elliptical cavity opening 28 for repair or replacement with a cam insert member 26 having a different size opening of the central serrated opening 42.

The elliptical cavity opening 28 and the elliptical cam body 40 are provided with co-acting elliptical surfaces such as 45 or 60 degree ellipitcal surfaces. An ellipse is defined as the sum of the distance from two fixed points to a point on the ellipse being a constant. A zero degree ellipse would be a straight line and a 90 degree ellipse would be a cirle. More specifically, the inner cam surface 35 of the elliptical cavity opening 28 is preferably formed from a 45 degree ellipse while the outer cam surface 46 of the cam insert member 26 is preferably formed from a 60 degree ellipse. Relative rotational movement of the 45 degree ellipse of the inner cam surface 35 causes a contact and clamping action against the outer cam surface 46 of the elliptical cam body 40 to create a clamping movement about the central serrated opening 42 to grasp or contact the bolt head member 18 as noted in FIG. 5. This cam action along with the serrated teeth operate to firmly grasp the stud member 14 or the bolt head member 18 for removing same.

It is noted that other relative sizes of ellipses could be used but the above noted relative sizes provide a preferred closing of the central serrated opening 42. The stud extractor and wrench apparatus 12 would function due to the slot 47 even if the inner cam surface 35 and the outer cam surface 46 were of the same size.

The main drive assembly 22 has two embodiments being (1) a ratchet drive assembly 48; and (2) a box end wrench drive assembly 50. As noted in FIG. 1, the ratchet drive assembly 48 includes a ratchet head assembly 52 connected to a ratchet handle member 54.

The ratchet head assembly 52 includes a ratchet housing 56 having mounted therein an actuator member 58 which, in turn, is connected to a connector member 60. The connector member 60 is provided with a square protrusion which would be engagable within the ratchet connector opening 34 in the ratchet head section 32 of the main cam lock assembly 20 as noted in FIG. 2. This would be a standard type ratchet drive connection.

The ratchet handle member 54 is provided with a grip section 62 integral with a body section 64. The ratchet handle member 54 is operable to be rotated in either direction depending on the position of the actuator member 58 so as to rotate the main cam lock assembly 20.

In the second embodiment, the main drive assembly 22 takes the form of the open box end wrench drive assembly 50 having a handle section 66 integral with a connector section 68 which, in turn, is connected to the main cam lock assembly 20. It is noted that this embodiment uses the second embodiment of the outer housing member 24 with the opposed lip sections 30, 36 and the aligned stud openings 38.

USE AND OPERATION OF THE INVENTION

In the use and operation of the stud extractor and wrench apparatus 12 of this invention as noted in FIG. 1, the ratchet drive assembly 48 can be utilized with the main cam lock assembly 20 having the outer housing member 24 which resembles a standard wrench socket member. The wrench head section 32 with the ratchet connector opening 34 can be attached to the ratchet head assembly 52 of the ratchet drive assembly 48 in a conventional manner. It is obvious that the ratchet handle member 54 can be rotated in opposite directions for rotation of the main cam lock assembly 20 as so desired.

It is obvious that one of numerous cam insert members 26 having various sizes of central serrated openings 42 can be selected relative to the items such as the bolt head member 18 to be worked upon. It is obvious that a snap ring tool structure having actuator prongs can be placed within the tool connector openings 44 in order to insert and remove a cam insert member 26 as required within the elliptical cavity opening 28 of the outer housing member 24.

On selecting the proper size cam insert member 26, the central serrated opening 42 is placed about the stud member 14 or the bolt head member 18 and the outer housing member 24 is rotated in either direction as noted by an arrow 72 in FIG. 5. This causes a closing movement of the adjacent surfaces of the opening or slot 47 to obtain a clamping action against the stud member 14 or the bolt head member 18. This then allows the grasping and rotation of the stud member 14 or the bolt head member 18 in either direction as noted by the arrow 72 for the tightening or removal thereof.

In cases where a stud member 14 or an elongated bolt member has its threads stripped, the embodiment of the box end wrench drive assembly 50 as shown in FIGS. 6 and 7 can be utilized. Due to the aligned stud openings 38, the central serrated opening 42 can be placed in any axially longitudinal position on a stud member 14 for grasping and subsequent removal thereof. The cam insert member 26 used with the box end wrench drive assembly 50 has the tool connector openings 44 so it can be utilized with a snap ring tool to be removed from the elliptical cavity opening 28 of the outer housing member 24 for replacing with a cam insert member 26 of various sizes as needed.

It has also been found that the new and novel cam action of the cam insert member 26 with its outer cam surface 46 cooperating with the inner cam surface 35 of the outer housing member 24 allows the clamping about hexagonal bolt head members 18 which can be utilized on adjacent sizes of metric wrenches. For example, a one-half ($\frac{1}{2}$) inch cam insert member 26 can be used on a ten (10) millimeter metric system bolt head member 18.

Although the invention is described with a 45 degree ellipse cooperating with a 60 degree ellipse, it is noted that various sizes of ellipses may function properly with the outer housing member 24 and cam insert member 26 of this invention, not requiring a large amount of area in order to do same. One prior art method of removing a stripped stud member 14 requires the drilling of a central hole and using an easy-out tool. This requires substantial skill and labor in drilling a hole into normally hardened steel plus requires substantial clearance in order to achieve this bolt extracting process.

The central opening 42 can be used without the teeth or notched sections 43 and conform to a hexagonal bolt head member 18 as shown in dotted lines in FIG. 5. The opening or slot 47 would then allow a clamping cam action about the hexagonal bolt head member 18.

It is noted that the cam insert member of this invention can be of various sizes and color coded. It can be constructed of hard plastic materials, brass, or the like and, if the central serrated opening therein becomes worn, the cam insert member can be replaced instead of the entire main drive assembly.

It is noted that the stud extractor and wrench apparatus of this invention is easy to use; economical to manufacture; substantially maintenance free; and usable in limited space situations.

While the invention has been described in conjunction with specific preferred specific embodiments thereof, it will be understood this description is intended to illustrate and not to limit the scope of the invention, which is defined by the following claims:

I claim:

1. A stud extractor and wrench apparatus operable to contact, grasp, rotate, remove or insert an object, comprising:

(a) a main drive assembly connected to a main cam lock assembly;

(b) said main cam lock assembly includes an outer housing member having a cam insert member mounted therein;

(c) said outer housing member formed within a elliptical cavity opening to receive and contact said cam insert member;

(d) said cam insert member provided with a main cam body having an opening and an outer cam surface; and (e) said outer cam surface engagable with said elliptical cavity opening and operable on relative rotation therebetween to change the size of said opening.

2. A stud extractor and wrench apparatus as described in claim 1, wherein:

(a) said cavity opening and said cam body of cooperating elliptical shapes operable on relative rotation to change the size of said opening.

3. A stud extractor and wrench apparatus as described in claim 1, wherein:

(a) said main drive assembly includes a box end wrench drive assembly connected to said outer housing member and operable to selectively rotate same in opposite directions relative to said cam insert member to cause a change in size of said opening; and (b) said housing member having aligned stud openings extended and aligned with said central opening;

whereby a stud can be placed with said central opening and laterally of said stud opening to grasp the stud at any longitudinal position for grasping, rotating, and removing same.

4. A stud extractor and wrench apparatus operable to contact, grasp, rotate, and remove or insert an object, comprising:

(a) a main cam lock assembly including a cam insert member mounted within a housing member;

(b) said cam insert member including a central opening to be placed about the object and an outer cam surface;

(c) said housing member having an inner cam surface engagable with said outer cam surface and operable on relative rotational movement of said inner cam surface and said outer cam surface to change the size of said central opening;

(d) said outer cam surface being of an elliptical shape; and (e) said inner cam surface being of an elliptical shape contacting and cooperating with said outer cam surface to provide a change in the size of said opening on relative rotation of said inner cam surface and said outer cam surface.

5. A stud extractor and wrench apparatus as described in claim 4, wherein:

(a) said cam insert member provided with a slot; and (b) said cam insert member provided with adjacent tool connector openings positioned adjacent said slot.

6. A stud extractor and wrench apparatus as described in claim 4, wherein:

(a) said cam insert member having aligned stud openings extended and aligned with said central opening to receive the object therethrough for grasping at any longitudinal position thereon.

7. A stud extractor and wrench apparatus as described in claim 8, including:

(a) a main drive assembly having a box end wrench drive assembly operably connected at one end to said outer housing member which is an integral part of said box end wrench drive assembly;

whereby said box end wrench drive assembly is operable to rotate said housing member relative to said cam insert member to change the size of said central opening.

8. A stud extractor and wrench apparatus as described in claim 7, wherein:

(a) said housing member having aligned stud openings extended and aligned with said central opening;

whereby an object of considerable length can be placed within said central opening said stud extractor and wrench apparatus can be utilized at any longitudinal position on the object for grasping, rotating, and removing same.

9. A stud extractor and wrench apparatus as described in claim 4, wherein:

(a) said outer cam surface defining a 60 degree ellipse; and (b) said inner cam surface defining a 45 degree ellipse.

10. A stud extractor and wrench apparatus operable to contact, grasp, rotate, remove or insert an object, comprising:

(a) a main cam lock assembly including a cam insert member mounted within a housing member;

(b) a cam insert member including a central opening to be placed about the object and an outer cam surface;

(c) said housing member having an inner cam surface engagable with said outer cam surface and operable on relative rotational movement of said inner cam surface and said outer cam surface to change the size of said central opening;

(d) said cam insert member provided with a slot which permits the movement thereof to decrease the size of said central opening; and (e) said cam insert member provided with adjacent tool connector openings positioned adjacent said slot;

whereby said tool connector openings are adapted to receive prongs from a tool member to decrease an outer size of said cam insert member in order to insert and remove said cam insert member from said housing member.

* * * * *